United States Patent [19]

Dahl

[11] 4,452,356

[45] Jun. 5, 1984

[54] PACKAGING FOR BAKERY ITEMS

[76] Inventor: Robert S. Dahl, 445 N. Twin Oaks Valley Rd., San Marcos, Calif. 92069

[21] Appl. No.: 446,468

[22] Filed: Dec. 3, 1982

[51] Int. Cl.[3] ..... B65B 25/16

[52] U.S. Cl. ..... 206/45.32; 206/467; 220/269

[58] Field of Search ..... 206/45.32, 467, 469, 206/631, 633, 484; 150/0.5; 229/43, 7 R; 220/269

[56] References Cited

U.S. PATENT DOCUMENTS

| | | | |
|---|---|---|---|
| 3,021,001 | 2/1962 | Donofrio | 229/43 |
| 3,093,244 | 6/1963 | Middleton, Jr. et al. | 206/484 |
| 3,272,422 | 9/1966 | Miller | 229/43 |
| 3,391,847 | 7/1968 | Christine et al. | 229/43 |
| 3,498,525 | 3/1970 | Zinkgraf | 229/43 |
| 3,690,902 | 9/1972 | Dahl | 206/45.32 |
| 3,835,224 | 9/1974 | Peters | 206/467 |
| 3,910,910 | 10/1975 | Shaw | 206/631 X |
| 4,196,809 | 4/1980 | Tonrey | 206/484 X |

FOREIGN PATENT DOCUMENTS

| | | | |
|---|---|---|---|
| 1580791 | 12/1980 | United Kingdom | 206/467 |

*Primary Examiner*—William Price
*Assistant Examiner*—Bryon Gehman
*Attorney, Agent, or Firm*—Gunn, Lee & Jackson

[57] ABSTRACT

A marketing package for fragile, icing coated bakery items is provided, comprising a paperboard base having a horizontal configuration conforming to that of the item to be packaged but extending horizontally beyond the edges of the item. A transparent plastic cover is provided having a top wall of the same configuration of the item to be packaged but of greater horizontal dimensions than the item and lesser dimensions than that of the paperboard base. An integral depending sidewall is peripherally attached to the top wall of the cover and the bottom edges of the sidewall are formed into a horizontal flange which rests on the perimeter of the paperboard base. Projecting tabs are peripherally spaced on the paperboard base and a score line is provided in the paperboard to permit such tabs to be readily deflected downwardly. At the same location, an integral horizontally projecting tab is provided on the bottom wall of the plastic cover to lie in overlying relationship to the paperboard tab, however, the plastic tab is substantially rigid relative to vertical displacement. A food grade tacky adhesive secures the overlying plastic cover tabs and base plate tabs and the plastic cover may be readily removed from the base plate by deflecting the base plate tabs downwardly to effect the shearing of the tacky adhesive.

11 Claims, 6 Drawing Figures

PACKAGING FOR BAKERY ITEMS

BACKGROUND OF THE INVENTION

1. Field of the Invention

The invention relates to a marketing package for relatively fragile bakery items, such as cakes and pastries which are generally fragile in nature and covered with an icing.

2. History of the Prior Art

Ever since the advent of the supermarket, bakeries have been seeking improved packaging for their fragile, icing covered items such as cakes and pastries. The essential requirement of such packaging is, of course, that it be economical, that the bakery item can be readily assembled in the package, that the bakery item is clearly displayed, yet protected while in the package, and that the package may be repeatedly opened and reclosed by the consumer to preserve the protection of the bakery item while the item is being consumed in the home.

Most housewives are familiar with the well known "Tupperware" brand of plastic containers, including a cake container embodying relatively heavy plastic base having an elevated rim portion and a dome-shaped cover having grooves mounted in the bottom periphery of the cover sidewalls which effect a snap engagement with the upstanding peripheral edges of the base. The characteristics of a container of this general type, particularly if it were to be made from a clear transparent plastic, would be ideal for the marketing of bakery products, but unfortunately, as is well known to those skilled in the art, the cost of this type of reusable container is far in excess of that permissible for a marketing package, the life of which is generally not in excess of two weeks, from the time that a bakery item is first placed in the package, through its shelf life in the store and through its normal life in the home until the bakery item packaged therein has been consumed.

Attempts have been made in the past to employ open top paperboard boxes for pastry items and then close the open upper portion of the box with a clear plastic sheet wrapped around the box. This method of packaging is distinctly undesirable in that the plastic sheet invariably contacts the icing in the course of handling the package and removes a portion of same whenever the plastic sheet is removed to provide access to the bakery item. Moreover, once the plastic sheet is opened, the package is essentially destroyed and cannot be used to protect the unconsumed portion of the bakery item.

There is a definite need, therefore, for a single trip marketing package for bakery items which is economical, will provide protection for the bakery item as it moves from the bakery to the market to the home, and is readily openable and reclosable by the consumer to permit access to the bakery item and to provide protection for any unconsumed portions of the bakery item. Lastly, the package must be transparent to afford the prospective customer a clear view of the bakery item that is being purchased.

SUMMARY OF THE INVENTION

The invention provides a marketing package for bakery items such as relatively fragile cakes and pastries, particularly those decorated with an icing, comprising a paperboard base of the same general configuration as the bakery item, i.e. if the cake is round, the base will be round. If the cake is rectangular, the base will be of rectangular shape. In any event, the base is of larger horizontal dimension that the bakery item so that when the bakery item is symmetrically placed on the base, a rim portion of the base extends beyond the exterior of the bakery item around all portions of the bakery item.

The paperboard base is additionally provided with a plurality of peripherally spaced, horizontally projecting tabs which extend even further beyond the perimeter of the bakery item positioned on the paperboard base. A score line is provided in the paperboard base in a generally transverse position relative to the projecting tabs, thus permitting such tab portions to be readily deflected in a downward direction.

A transparent, generally hat-shaped, plastic cover is then provided for the base. Such cover is preferably formed by vacuum or thermoforming operations on plastic sheets.

The transparent plastic cover includes a top wall of the same general configuration as the bakery item to be packaged, being of greater horizontal dimensions than the bakery item, yet smaller in horizontal dimensions than the paperboard base. An integral depending sidewall is peripherally attached to the top wall. Such sidewall is of a height exceeding the height of the bakery item to be packaged. The bottom edge of the sidewall is formed with a horizontal peripheral flange which normally rests on the peripheral portions of the paperboard base. Additionally, the bottom portion of the sidewall is provided with horizontally projecting tab portions, of the same general configuration as the tabs on the paperboard base and disposed to be alignable in overlying, abutting relationship with the base tabs. A food grade adhesive is then applied between the plastic tabs on the cover and the paperboard tabs on the base to effect the securement of the plastic cover to the base. Such adhesive is a common type generally described as a "tacky" adhesive which will maintain its tackiness over the expected life span of the bakery package.

To permit the separation of the paperboard tabs from the plastic cover tabs, the plastic cover tabs are substantially rigidified through the provision of an arcuate surface at the juncture of the sidewall and plastic tabs, or vertically extending integral ribs or corrugations in the sidewall portion immediately adjacent to the plastic tabs. Thus, when pressure is applied by the finger to the outer periphery of a base tab, it will deflect downwardly with respect to the relatively rigid plastic tab and readily effect the severance of the adhesive bond. Thus, the cover may be readily recoved from the bakery item, a portion of the bakery item cut for comsumption, and the remaining portion replaced on the paperboard base and recovered with the transparent plastic cover by resecuring the plastic cover tabs to the paperboard base tab by squeezing such tabs together and permitting the tacky adhesive to maintain the tabs in engagement.

In a modified form of the invention, particularly adapted for utilization with generally rectangularly shaped bakery items, the paperboard base is formed as a regular rectangle whose horizontal dimensions exceed those of the bakery item to be packaged. Thus, the four corner portions of the rectangular paperboard base extend outwardly a substantial distance from the corner of the bakery item and become the base tabs. The transparent plastic cover is then formed as a rectangle whose sidewalls are of greater horizontal dimension than the bakery item to be packaged but of lesser dimension than the paperboard base, and the corners of the transparent plastic cover are defined by arcuate surfaces. The tabs on the plastic cover then project horizontally outwardly from the arcuate corner portions and respectively overlie each of the four corners of the rectangular paperboard base portion. The plastic tabs are substantially rigidified by being integrally connected to the curved corner portions. As in the previous modification, a score line is provided extending diagonally across each of the projecting corners of the paperboard base and this permits any one of the corners to be readily flexed in a downward direction to effect the release of the tacky adhesive disposed between the contiguous plastic cover tabs and the paperboard base corners.

Further objects and advantages of the invention will be readily apparent to those skilled in the art from the following detailed description, taken in conjunction with the annexed sheets of drawings, on which is shown three preferred embodiments of the invention.

DESCRIPTION OF THE PREFERRED EMBODIMENTS

Figure 1:
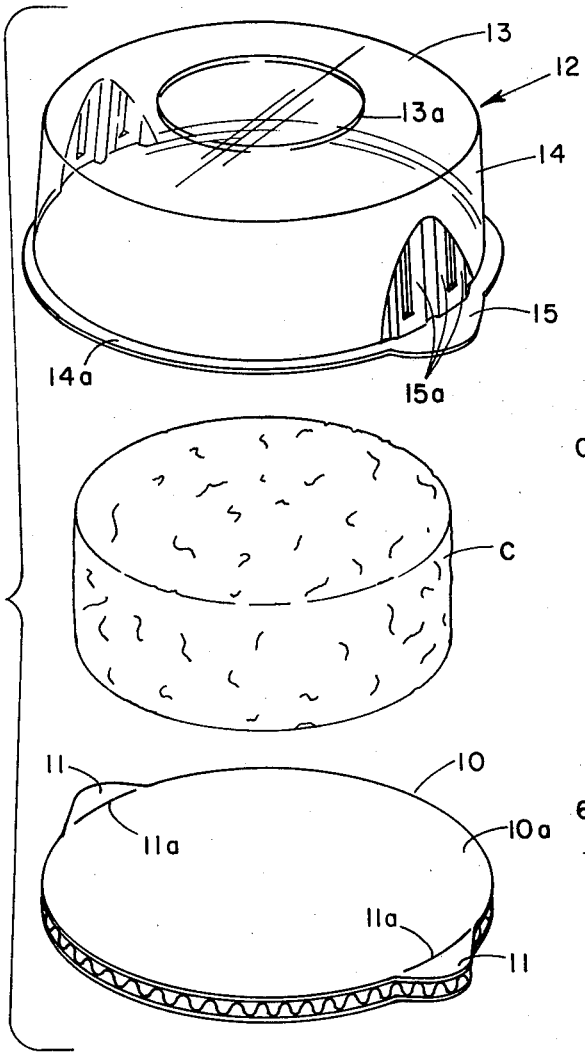
FIG. 1 is an exploded perspective view of a package for a bakery item constructed in accordance with this invention.

Referring to FIG. 1 there is shown a package for bakery items C of a round configuration, such as a cake decorated with icing. Package 1 comprises a relatively rigid base portion 10 formed of thin caliper corrugated board not exceeding one eighth of an inch in thickness.

The upper surface 10*a* of the base plate 10 is either coated with a decorated sheet of paper or plastic or the top inner sheet is printed to provide an attractive surface on which to mount the bakery item.

The horizontal dimensions of base 10 are substantially in excess of the horizontal dimensions of the bakery item C so that when the bakery item is symmetrically positioned on the base plate 10, (FIG. 2) a peripheral rim portion of the base plate 10 extends beyond the periphery of the bakery item. At peripherally spaced intervals around the periphery of the base plate 10, there are provided a plurality of horizontally projecting cover securement tabs 11. Such tabs are integrally formed with the base plate 10 and are preferably given an arcuate peripheral configuration to enhance the appearance of the package.

A score line 11*a* is provided near the juncture of the tab 11 with the periphery of the base plate 10. Such score line 11*a* is preferably of arcuate configuration and may comprise a cut extending through most of the thickness of the base plate 10 but not the bottom liner. The purpose of score line 11*a* is to permit the corresponding tab 11 to be deflected downwardly relative to the plane of the remainder of the base plate 10. Instead of actual scoring, the paperboard material may be compressed to form such score line and the term "score line" should be understood to include either a line produced either by cutting or compressing, thus permitting the forceable bending of the tabs 11 about such lines.

A transparent plastic cover 12 is provided for the bakery package 1 and is of generally hat-shaped configuration so as to freely surround the bakery item C to be packaged when it is symmetrically positioned on the base plate 10. Plastic cover 12 is preferably formed by vacuum or thermoforming operations on a sheet of transparent thermoplastic material. Thermoplastic sheet formed from oriented polystyrene material and having an original thickness on the order of 12.5 to 20 mils is preferably utilized. Plastic cover 12 includes a top wall portion 13 which is the same general configuration as the bakery item to be packaged and as the base plate 10. A circular reinforcing rib 13*a* may be formed in top wall 13. The horizontal dimensions of wall portion 13 are, however, greater than the dimensions of the bakery item to be packaged but less than the horizontal dimensions of the base plate 10.

Figure 2:
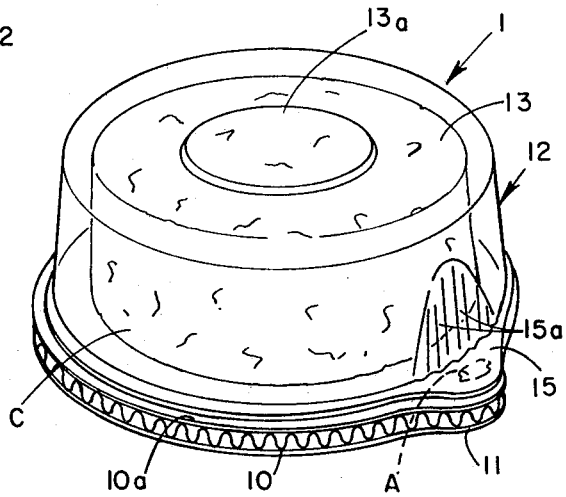
FIG. 2 is a perspective view of the bakery item package of FIG. 1 in an assembled relation.

An integral depending wall 14 is peripherally attached to the top wall 13 and terminates in a horizontal flange 14*a* which rests upon the perimetral portions of the base plate 10. At peripherally spaced intervals around the bottom of the vertical wall 14, there are formed horizontally projecting plastic tabs 15 of the same general configuration and location as the projecting tabs 11 provided on the base plate 10. The plastic cover tabs 15 are substantially rigidified by being connected to a horizontally curved portion of the sidewall 14 of plastic cover 12. Such rigidifying sidewall element may take the form of vertically extending corrugations or ribs 15*a* provided on sidewall 14 only in the vicinity of the tabs 15 as shown in FIG. 2, or, referring to FIG. 3, the entire vertical sidewall 14 may be provided with vertically extending corrugated ribs 17 to enhance the artistic appearance of the resulting package and rigidity of the entire sidewall.

Figure 6:
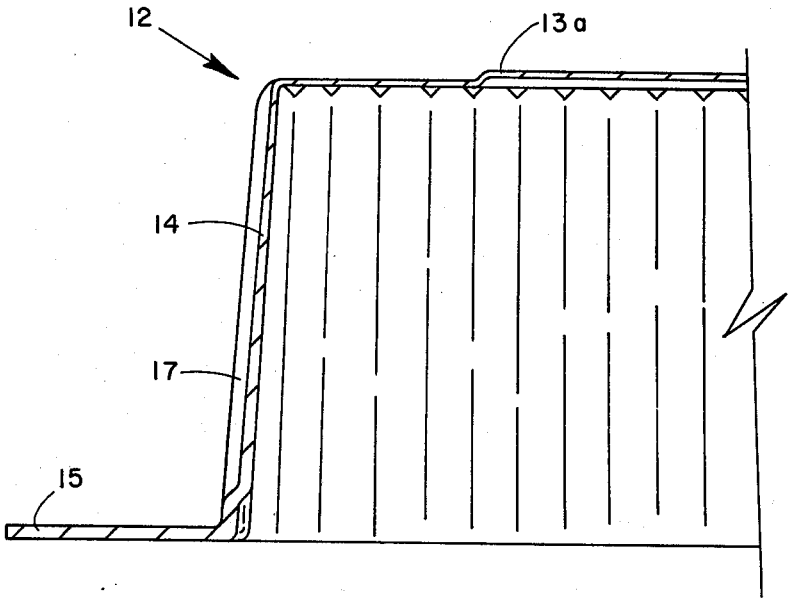
FIG. 6 is an enlarged scale sectional view of the transparent cover taken on the plane 6—6 of FIG. 3.

By virtue of the vacuum forming or thermoforming operations, the amount of thermoplastic material required for cover 12 is minimized. As illustrated in FIG. 6, the thickness of panel portion 13 is on the order of 6 mils, while flange portion 14*a* approaches the original sheet thickness of 14 mils.

The bakery item C to be packaged is symmetrically placed on the base plate 10 and a small quantity of a food grade adhesive A is applied to the bottom surfaces of the plastic cover tabs 15 so as to effect the securement of the plastic cover tabs 15 to the base tabs 11. Such adhesive should be one that is approved by the F.D.A. for use with food products and is preferably of the type known as a "tacky" adhesive which will maintain its tackiness for a period of several weeks. A preferred adhesive is that sold by H. B. Fuller Company, under the Product Number XS-001. Finger pressure applied to the overlying plastic cover tabs 15 and the base plate tabs 11 will effect their securement by the aforementioned tacky adhesive A, and the bakery item C is ready to go to market.

Figure 3:
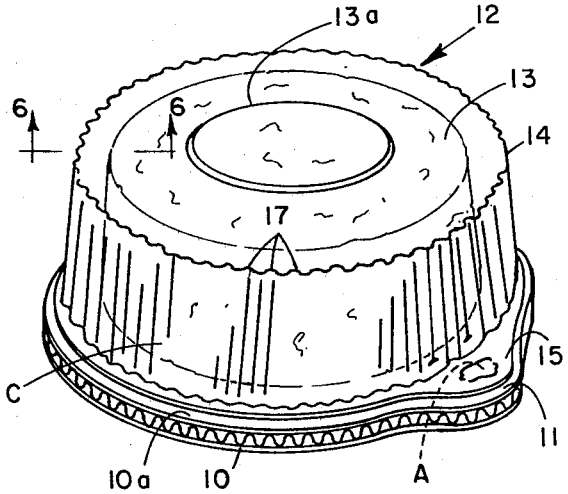
FIG. 3 is a perspective view of a modified bakery item package.
Figure 4:
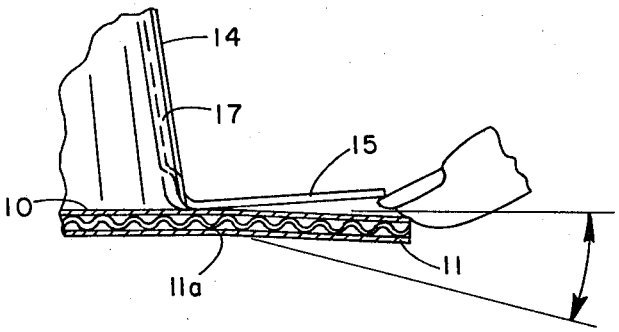
FIG. 4 is a vertical sectional view taken through one of the tab portions of the bakery item package shown in FIG. 3, illustrating the separation of the tab portions by downward application of finger pressure.

When the consumer is ready to consume the bakery item, it is only necessary for a modest downward pressure to be applied by a finger to the outer extremity of the base plate tab 11 to effect the disengagement of such tabs from the plastic cover tabs 15 (FIG. 4). Such disengagement occurs almost with a snap action due to the fact that the base plate tabs 11 are flexible by virtue of the provision of the score lines ll*a* and the plastic cover tabs 15 are relatively rigid due to the provision of the rigidifying ribs or corrugations 15*a* or 17 as shown in the modifications of FIGS. 1 and 3. After removal of the bakery item and cutting off a portion to be consumed, the unconsumed portion may be replaced on the base plate 10 and the protective plastic cover 12 reapplied thereto by squeezing the plastic cover tabs 15 into intimate engagement with the paperboard base tabs 11.

Figure 5:
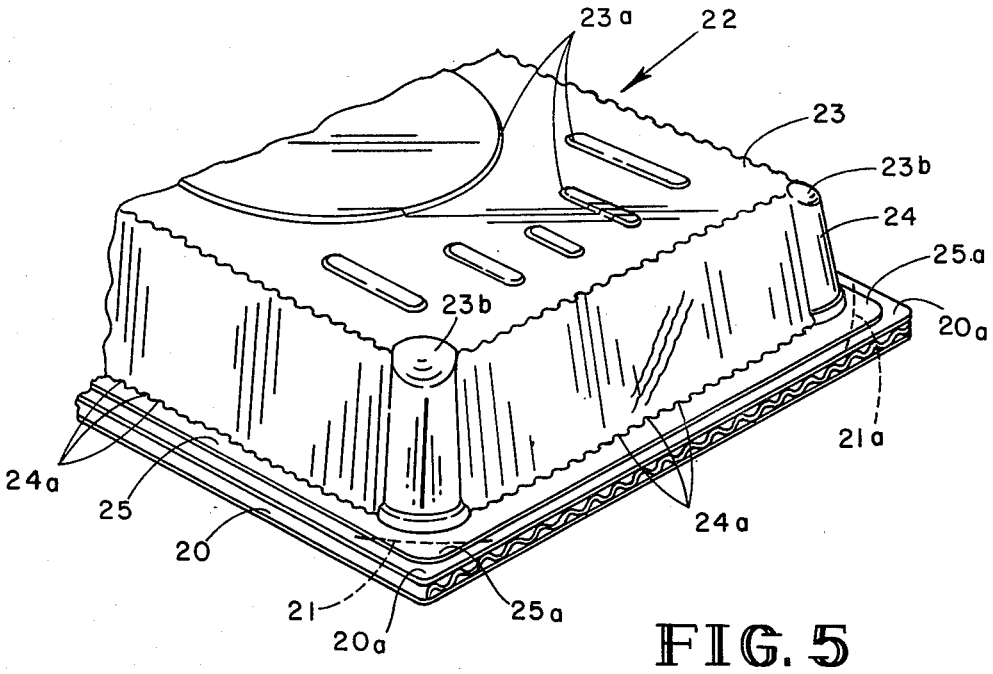
FIG. 5 is a perspective view of a bakery item package embodying this invention constructed for a rectangular bakery item.

Referring now to FIG. 5, there is shown a modification of this invention employed for the packaging of relatively large rectangular bakery items. For this application, the paperboard base plate 20 is cut of rectangular configuration, exceeding of course, the horizontal dimensions of the bakery item to be packaged. As a result, the four corners 20*a* of the rectangular paperboard base 20 project substantially beyond the corner extremities of the bakery item to be packaged. Score lines 21 extending generally diagonally across the corners 20*a* respectively provide the desired vertical flexibility of the respective corners which now function as the projecting tabs 11 of the previous modification. Score lines 21 are preferably slightly arcuate in configuration.

The cover 22 is fabricated by vacuum forming or thermoforming operations on transparent thermoplastic sheet in the same manner as previously described. Because of the greater dimensions, it may be desirable to incorporate a plurality of reinforcing ribs 23*a* in the top wall 23 of the generally rectangularly shaped plastic cover 22. Additionally, the corner portions of the plastic cover 22 are not rectangularly formed but are formed of a generally arcuate horizontal cross-sectional configuration, as indicated at 23*b*. As in the previous modification, an integral depending sidewall 24 is peripherally attached to top wall 22. A horizontally extending peripheral flange 25 is forxed on the bottom portion of the integral depending sidewall 24 which overlies the peripheral portions of the base plate 20 and, of course, is horizontally spaced from the extremities of the bakery item to be packaged. The plastic cover tabs 25*a*, respectively constitute the corner portions of the peripheral horizontal flange 25 and respectively overlie the corner portions 20*a* of the paperboard base 20. As in the previous modification, a tacky, food grade adhesive (not shown) is employed to effect the securement of the plastic cover tabs 25*a*, respectively to the corner tabs 20*a* of the paperboard base 20.

To improve the vertical rigidity of the sidewalls 24, those portions of the sidewall 24 intermediate the rounded corner portions 23*b* are provided with vertically extending ribs or corrugations 24*a*. The operation of this embodiment of the invention is identical to that previously described.

Although the invention has been described in terms of specified embodiments which are set forth in detail, it should be understood that this is by illustration only and that the invention is not necessarily limited thereto, since alternative embodiments will become apparent to those skilled in the art in view of the disclosure. Accordingly, modifications are contemplated which can be made without departing from the spirit of the described invention.

What is claimed is:

1. A package for bakery items comprising, in combination, a paperboard base conforming in horizontal configuration to the bakery item to be packaged but being horizontally larger than such bakery item; said base having a plurality of peripherally spaced, laterally projecting flexible tabs; a cover formed from transparent thermoplastic sheet, said cover having a top wall conforming in horizontal configuration to the bakery item to be packaged, said top wall being horizontally larger than such bakery item but smaller than said base; a sidewall depending peripherally from said top wall and having a bottom edge resting on the periphery of said paperboard base; said sidewall being of greater height than the bakery item and having horizontally projecting integral tab portions on its bottom edge respectively constructed and arranged to overlie said paperboard base tabs; said cover tab portions being substantially rigid relative to said sidewall; a food grade tacky adhesive disposed between the abutting surfaces of said cover tabs and said base tabs for sealing and resealing said package; and a score line formed in said paperboard base in transverse relation to each of said base tabs, whereby said base tabs may be manually deflected downwardly to release the adhesive securement to said cover tabs, said package thereby being adapted to permit repeated and alternate secure engagement or disengagement of said cover and said paperboard base.

2. The package defined in claim 1 wherein said peripheral sidewall is of arcuate horizontal cross-sectional configuration adjacent each of said cover tabs, thereby rigidifying said cover tabs against vertical deflection.

3. The package defined in claim 1 wherein said peripheral sidewall is of corrugated horizontal cross-section adjacent each of said cover tabs, thereby rigidifying said cover tabs against vertical deflection.

4. The package defined in claim 1 wherein said peripheral sidewall is entirely of corrugated horizontal cross-section, thereby rigidifying said cover tabs against vertical deflection.

5. The package defined in claim 1 wherein said peripheral sidewall of said cover has a continuous horizontal flange on its bottom edge and said cover tabs comprise integral extensions of said horizontal flange.

6. The package defined in claim 5 wherein said peripheral sidewall is of arcuate horizontal cross-sectional configuration adjacent each of said cover tabs, thereby rigidifying said cover tabs against vertical deflection.

7. The package defined in claim 5 wherein said peripheral sidewall is of corrugated horizontal cross-section adjacent each of said cover tabs, thereby rigidifying said cover tabs against vertical deflection.

8. The package defined in claim 5 wherein said peripheral sidewall is entirely of corrugated horizontal cross-section, thereby rigidifying said cover tabs against vertical deflection.

9. A package for generally rectangular bakery items comprising, in combination: a rectangular paperboard base conforming to the configuration of the bakery item but horizontally larger than such item so that the flexible corner portions of said base respectively project substantially beyond the corners of any such bakery item symmetrically positioned thereon; a cover formed from transparent thermoplastic sheet; said cover having a generally rectangular top wall with rounded corners, said cover top wall being horizontally larger than the rectangular bakery item but horizontally smaller than said paperboard base; a peripheral depending sidewall integrally formed on said top. wall and having a bottom edge resting on the periphery of said paperboard base; an integral horizontal tab formed on the bottom edge of each rounded corner of said cover sidewall; said cover tabs being respectively constructed and arranged to respectively overlie the four corners of said paperboard base; a food grade tacky adhesive disposed between the abutting surfaces of said cover tabs and said base corners for sealing and resealing said package; and a score line diagonally traversing each of said corner portions of said paperboard base; thereby permitting manual downward deflection of each of said base corners to release the adhesive engagement with the overlying cover tab, said package thereby being adapted to permit repeated and alternate secure engagement or disengagement of said cover and said paperboard base.

10. The package defined in claim 9 wherein said peripheral sidewall of said cover has a continuous horizontal flange on its bottom edge and said cover tabs comprise integral extensions of said horizontal flange.

11. The package defined in claim 9 wherein those portions of said cover sidewall intermediate said rounded corners are of corrugated horizontal cross-section.

* * * * *